US008449241B2

(12) United States Patent
Fritsch

(10) Patent No.: US 8,449,241 B2
(45) Date of Patent: May 28, 2013

(54) GRAPPLE FOR A SKID STEER LOADER

(76) Inventor: Ronald M. Fritsch, Greenleaf, WI (US)

( * ) Notice: Subject to any disclaimer, the term of this patent is extended or adjusted under 35 U.S.C. 154(b) by 600 days.

(21) Appl. No.: 12/748,567

(22) Filed: Mar. 29, 2010

(65) Prior Publication Data

US 2011/0236170 A1 Sep. 29, 2011

(51) Int. Cl.
*E02F 3/413* (2006.01)

(52) U.S. Cl.
USPC ..... 414/724; 414/729; 294/106; 37/405; 37/406

(58) Field of Classification Search
USPC ..... 414/729, 724; 294/106; 37/406, 37/405
See application file for complete search history.

(56) References Cited

U.S. PATENT DOCUMENTS

| | | | | |
|---|---|---|---|---|
| 4,863,338 | A * | 9/1989 | Johnson | 414/704 |
| 6,287,072 | B1 * | 9/2001 | Wasilas | 414/729 |
| 6,932,556 | B1 * | 8/2005 | Ecker | 414/724 |
| 6,939,099 | B1 * | 9/2005 | Stokkeland | 414/729 |

* cited by examiner

*Primary Examiner* — Scott Lowe
(74) *Attorney, Agent, or Firm* — Nikolai & Mersereau, P.A.; Thomas J. Nikolai

(57) ABSTRACT

A hydraulically-operated grapple attachment for the scoop bucket of a skid steer loader comprises a mounting bar running the length dimension of the bucket along a top rear edge thereof and pivotally attached to the mounting bar by tubular steel arms is a crossbar member having perpendicularly oriented tines projecting downward therefrom where at least one of the tines is hydraulically displaceable in a direction forward from the crossbar. Actuation of the hydraulically-movable tine serves to prevent the skid steer loader from becoming mired.

9 Claims, 1 Drawing Sheet

GRAPPLE FOR A SKID STEER LOADER

BACKGROUND OF THE INVENTION

I. Field of the Invention

This invention relates generally to an attachment for a skid steer loader-type work vehicle, and more particularly to a hydraulically-actuated grapple for use in handling compacted silage.

II. Discussion of the Prior Art

For many years, dairy farms have stored corn stalks and other forage plants as silage in tall, vertical tanks called silos. The plant material is collated, chopped into pieces and fed into a stationary machine called as "silo filler" that would further chop the stalks and blow them up a narrow tube to the top of a tower silo. Current technology uses mechanical forage harvesters that collect and chop the plant material, and deposit it in trucks or wagons. These forage harvesters can be either tractor-drawn or self-propelled. They blow the silage into the wagon via chute at the rear or side of the machine. Silage may also be emptied into a bagger, which puts the silage into a large plastic bag that is laid out on the ground. Typically, these bags may have a diameter anywhere from four to ten feet and may be 200 feet or more in length.

Silage undergoes anaerobic fermentation, which typically starts about 48 hours after the bag is filled. The process converts sugars to acids and exhausts an oxygen present in the crop material. Fermentation is essentially complete after about two weeks. When bagging of silage is employed, it must be firmly packed to minimize the oxygen content or it will spoil.

The ensiled product retains a much larger proportion of its nutrients than if the crop had been dried and stored as hay or stover. Bulk silage is commonly fed to dairy cattle. Common forages converted to silage include several varieties of grasses, herbaceous legumes, alfalfa and sorghums. When the silage is loaded into silage bags, the material becomes highly compacted and tightly contained so as to minimize oxygen exposure. As such, the material within the bag becomes somewhat entangled and solid in its texture.

When it is desired to remove the compacted silage from the bag in quantities sufficient to feed, say, a herd of say 50 cows, front end loaders, also referred to as skid steer loaders, may be used to remove a quantity of silage and load IT onto a truck for transport to a feeding site. It has also been a practice to incorporate a hydraulic grapple onto the bucket of a skid steer loader to facilitate separating silage from the compacted mass and loading the separated quantity into the bucket of the skid steer loader. The process starts at one end of the elongated bag and before too long, the ground on which the skid steer loader must operate becomes quite slippery from the moist silage and the weather. As a result, the skid steer loader wheels frequently loose traction and the vehicle can become stuck, especially where the grapple tines are embedded in the tightly compacted silage. It may then become necessary to dump the full bucket or hook up the skid steer loader to a truck being loaded using a chain to pull it free from the compacted silage. This, of course, takes time that can be better spent on other chores.

The present invention provides a novel and non-obvious solution to the aforementioned problem.

SUMMARY OF THE INVENTION

A grapple attachment for a bucket of a skid steer loader comprises a crossbar pivotally affixed to the scoop bucket where the crossbar supports a plurality of parallel tines and a hydraulic actuator for rotating the crossbar and tines between a raised state and a lowered state with respect to an open top and front of the scoop bucket. The grapple attachment is characterized in that at least one of the plurality of parallel tines is connected to a piston rod of a hydraulic cylinder which, when actuated, advances the one tine outward from the crossbar and beyond the row of fixed tines mounted on the crossbar.

DESCRIPTION OF THE DRAWINGS

The foregoing features, objects and advantages of the invention will become apparent to those skilled in the art from the following detailed description of a preferred embodiment, especially when considered in conjunction with the accompanying drawings in which like numerals in the several views refer to corresponding parts.

DESCRIPTION OF THE PREFERRED EMBODIMENT

Figure 4:
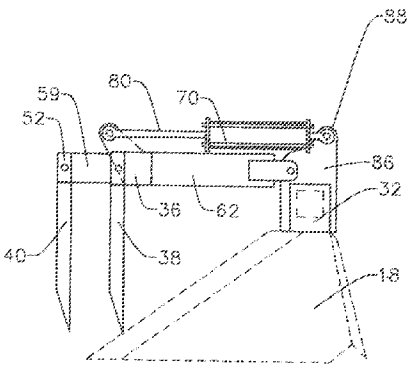
FIG. 4 is an end view showing the movable tines extended relative to the fixed tines.

This description of the preferred embodiments is intended to be read in connection with the accompanying drawings, which are to be considered part of the entire written description of this invention. In the description, relative terms such as "lower", "upper", "horizontal", "vertical", "above", "below", "up", "down", "top" and "bottom" as well as derivatives thereof (e.g., "horizontally", "downwardly", "upwardly", etc.) should be construed to refer to the orientation as then described or as shown in the drawings under discussion. These relative terms are for convenience of description and do not require that the apparatus be constructed or operated in a particular orientation. Terms such as "connected", "connecting", "attached", "attaching", "join" and "joining" are used interchangeably and refer to one structure or surface being secured to another, structure or surface or integrally fabricated in one piece, unless expressively described otherwise.

Figure 1:
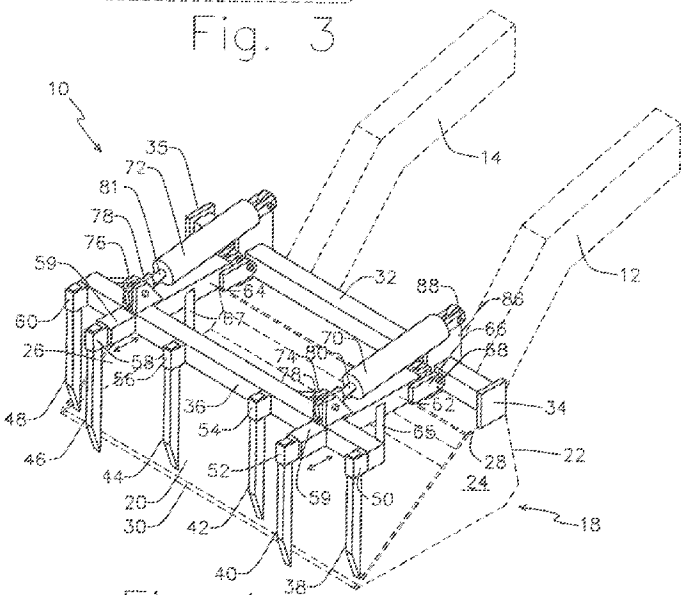
FIG. 1 is a perspective view of a grapple attachment for a skid steer loader work vehicle embodying my invention.

Referring first to FIG. 1, there is indicated generally by numeral 10 a grappling attachment constructed in accordance with the present invention. It is shown as being attached to the hydraulically-activated arms 12 and 14 of a skid loader work vehicle (not shown). While also not shown in FIG. 1, the grapple assembly 10 incorporates the conventional quick connect coupler rather universally used for joining various attachments to the hydraulically-operated arms 12, 14 of the skid steer loader.

The grapple is seen to comprise a scoop bucket 18 having a bottom surface 20, a rear surface 22 and triangularly shaped side surfaces 24 and 26 wherein the hypotenuse of each triangle extends from an upper edge 28 of the rear surface to a front edge 30 of the bottom surface 20. The scoop bucket is of a welded construction and preferably made from 2¼ inch gauge cold rolled steel. Extending along the length dimension of the upper edge 28 is a steel tube of rectangular cross-section 32 that is affixed to the scoop bucket 18 by welded end brackets 34 and 35.

The grapple of the present invention further includes a crossbar member 36 to which is attached a plurality of teeth or tines 38 . . . 48 and which extend perpendicularly thereto. More particularly, the tines 38 . . . 48 are removably secured to the crossbar 36 by U-shaped brackets 50 . . . 60 that are welded to the crossbar and which surround three sides of the tines. Bolts passing through the brackets and tines hold the tines in place.

The crossbar member 36 is pivotally connected to the rectangular tube 32. More particularly, tubular steel arms 62 and 64 of rectangular cross-section are welded at a first end to the crossbar member 36 and are connected by braces 65 and 67. The arms 62 and 64 are pivotally connected to the rectangular tube 32 that extends along the length dimension of the scoop bucket by a clevis connection, as at 66, having a hinge pin 68 that acts as the axis of rotation for the crossbar member 36 and its attached tines. The tubular arm 64 attaches to the crossbar member 36 and to the rectangular tube 32 in an identical manner as the tubular arm 62.

In FIG. 1, the crossbar and its attached tines are shown in a closed or lowered position relative to the bottom surface 20 of the scoop bucket 18. Hydraulic cylinders or actuators, as at 70 and 72, are deployed so as to be able to lift and rotate the crossbar and tines clockwise when viewed as in FIG. 1 so that the tines no longer block the otherwise open front of the scoop bucket 18. To achieve this result, a pair of ears 74 and 76 is welded to the crossbar member 36 that are spaced apart from one another so as to receive therebetween a coupler 78 fastened to the end of a piston rod 80 of a hydraulic actuator 70. A hinge pin 84 pivotally couples the coupler 78 to the ears 74, 76.

The rightmost end of the cylinder 70 is also pivotally coupled to an upright ear 86 that is welded to the upper surface of the rectangular tube 32. A hinge pin 88 pivotally joins the right end of the cylinder 70 to the ear 86. The hydraulic actuator 72 is connected between the crossbar member 36 and the rectangular tube 32 in exactly the same manner and, thus, need not be described in detail.

Those skilled in the art can appreciate that, because the stroke axis of the cylinders 70 and 72 are displaced from the pivot axis of the crossbar member defined by the hinge pin 88, when the piston rods 80 and 81 of the cylinders 70 and 72, respectively, are simultaneously retracted into their respective cylinders, the crossbar 36 with the teeth 38-48 will rotate clockwise when viewed as in FIG. 1.

Figure 2:
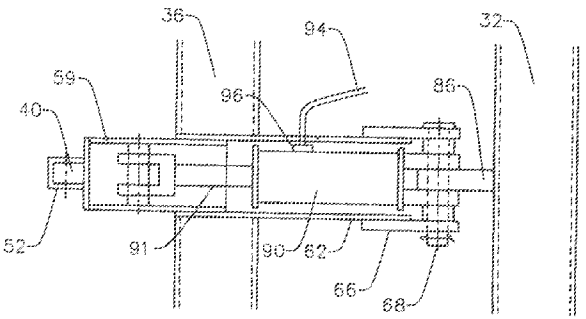
FIG. 2 is a cross-sectional view taken through one of the pivot arms and showing a hydraulic actuator contained therein.

Referring next to FIG. 2, there is shown a longitudinal cross-section through the steel tubular arm 62 to which the crossbar member 36 is welded at one end and that is pivotally connected to the rectangular tube 32 through the clevis connection 66 with its hinge pin 68. Contained within the hollow interior of the rectangular tube 62 is a further hydraulic cylinder 90 whose piston rod 91 extends through aligned bores formed through the opposed sidewalls of the crossbar member 36 and into a slide 59 to which the bracket 52 that is affixed to the tine 40 is connected. The opposite end of the cylinder is pivotally connected to the inner sidewall of the rectangular tube 32 by a clevis connection 68, allowing the cylinder 90 to rotate with the outer arm 62. A hydraulic connection to the cylinder 90 is made through a hose 94 and a conventional hose connector 96 that extends through the wall of the rectangular tube 62. The tubular arm 64 also contains a hydraulic actuator configured in the same way as cylinder 90 of FIG. 2.

Actuation of the cylinder 90 and its counterpart in arm 64 will cause reciprocal movement of the cylinder rods liked 91. The stroke length thereof is approximately 8 inches.

Figure 3:
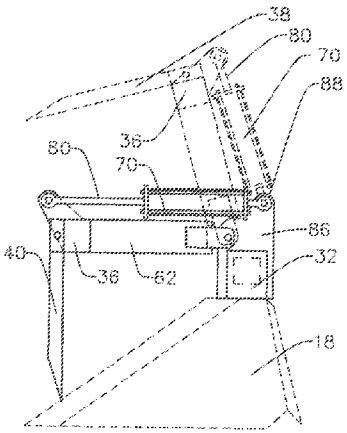
FIG. 3 is an end view of the preferred embodiment with the grapple shown in its raised position in ghost line and in its lowered position in solid line.

When used to remove silage from a conventional silage storage bag, the operator will approach the open end of the silage bag with the tines 38-48 elevated as in FIG. 3 and will drive the scoop bucket 18 into the mass of silage at which point the hydraulic cylinders 70 and 72 will be actuated to swing the crossbar and tines into the mass of silage, thereby penetrating into a mass of silage sufficient to fill the scoop bucket. The operator will then attempt to maneuver the skid steer loader to empty the silage from the scoop bucket into a nearby truck or wagon (not shown) that will be used to carry the silage to the point where it is to be fed to the animals. Before too long, the ground surrounding the open end of the silage bag will become wet and slippery from the moist silage such that the wheels of the skid steer loader will often loose sufficient traction to allow the tines to be pulled free from the mass of silage and the vehicle becomes stuck. When this occurs, the operator can operate a control lever on a valve box in the cab to deliver hydraulic fluid under high pressure to the cylinders 90 contained within the steel tube arms 62 and 64 causing the two tines 40 and 46 to push out and away from the crossbar member 36 as in FIG. 4, so as to push against the silage mass with a force sufficient to overcome the retaining force acting against the remaining tines and effectively freeing the fixed tines and moving the skid steer loader vehicle rearward away from the mass of silage and thus obviating the need to use another vehicle to pull the skid steer loader and scoop bucket free from its stuck condition.

The hydraulic system for the skid steer loader including its main hydraulic pump and the oil flow controller in the operator's cab are used to deliver hydraulic fluid to the lift cylinders 70 and 72 and to the push-out cylinders 90. It has been found convenient to employ a sequence-type valve in the hydraulic circuit for the grapple arranged such that when the pressure applied to the cylinders 70 and 72 reach a predetermined setting, hydraulic oil flow is directed to the cylinders 90 to push out the tines 40 and 46. For example, when the pressure forcing the piston rods 80 and 81 out reaches about 2,500 pounds, when typically only occurs when the tines 38 . . . 48 are no longer able to penetrate deeper into the silage mass, the sequence valve operates to direct hydraulic oil flow to the cylinders 90 allowing about 12 tons of force for pushing against the compacted mass of silage to thereby displace the work vehicle from a stuck position.

Those skilled in the art can appreciate that while a sequence valve is well suited to the present invention, a separate electrically-operated valve may also be used to control hydraulic oil flow to the cylinders 90 once it is determined that the work vehicle has become mired.

This invention has been described herein in considerable detail in order to comply with the patent statutes and to provide those skilled in the art with the information needed to apply the novel principles and to construct and use such specialized components as are required. However, it is to be understood that the invention can be carried out by specifically different equipment and devices, and that various modifications, both as to the equipment and operating procedures, can be accomplished without departing from the scope of the invention itself.

What is claimed is:

1. An attachment adapted to be carried on hydraulically-activated arms of a skid steer loader work vehicle, comprising:

(a) a grapple having a scoop bucket attachable to said hydraulically-actuated arms of a skid steer loader work vehicle, the scoop bucket having a generally rectangular bottom surface, a rear surface, an open top and sloping side surfaces extending from the rear surface to a front edge of the bottom surface, a crossbar pivotally hinged to an upper edge of the rear surface and supporting a plurality of perpendicularly extending tines; a first hydraulic actuator operatively coupled between said upper edge of the rear surface of the scoop bucket and the crossbar for rotating the crossbar and the plurality of tines between an elevated open position and a lowered closed position relative to the front edge of the bottom surface; and (b) a second hydraulic actuator operatively coupled to one of the plurality of tines for reciprocally displacing said one tine forward of the crossbar independent of the other of the plurality of tines.

2. The attachment of claim 1 wherein two hydraulic actuators are operatively coupled between the upper edge of the rear surface of the scoop bucket and the crossbar at spaced-apart positions along the crossbar.

3. The attachment of claim 2 and further including a third hydraulic actuator operatively coupled to another of the plurality of tines for reciprocally displacing said another tine forward of the crossbar.

4. The attachment of claim 3 wherein the second and third hydraulic actuators are contained within tubular arms disposed adjacent to and beneath the two hydraulic actuators.

5. The attachment of claim 4 wherein the tubular arms pivotally join the upper edge of the rear surface of the scoop bucket to the crossbar.

6. The attachment of claim 4 and further including hydraulic hoses adapted to connect the two hydraulic actuators, the second and the third hydraulic actuators to the hydraulic system of the skid steer loader work vehicle.

7. The attachment of claim 1 and further including hydraulic hoses adapted to connect the first and second hydraulic actuators to a source of hydraulic pressure for the skid steer loader work vehicle.

8. A grapple attachment for a scoop bucket adapted to be coupled to hydraulic arms of a skid steer loader where the scoop bucket has an open top and open front, the grapple attachment comprising: a crossbar pivotally affixable to the scoop bucket, the crossbar supporting a plurality of parallel, longitudinally-spaced tines, and a first hydraulic actuator for pivoting the crossbar and tines between a raised state and a lowered state with respect to the open top and front of the scoop bucket, characterized in that at least one of the plurality of parallel tines is connected to a piston rod of a second hydraulic actuator which, when actuated, advances the one tine outward from the crossbar independent of remaining ones of the plurality of tines.

9. The grapple attachment of claim 8 wherein two of the plurality of tines are connected to piston rods of separate hydraulic cylinders where said two tines are laterally spaced apart from one another along a length dimension of the crossbar.

* * * * *